US007554501B2

(12) United States Patent
Park et al.

(10) Patent No.: US 7,554,501 B2
(45) Date of Patent: Jun. 30, 2009

(54) LOOP ANTENNA HAVING MATCHING CIRCUIT INTEGRALLY FORMED

(75) Inventors: Wee-sang Park, Yongin-si (KR); Yoon-taek Lim, Yongin-si (KR); Young-eil Kim, Yongin-si (KR); Yong-jin Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 19 days.

(21) Appl. No.: 11/645,774

(22) Filed: Dec. 27, 2006

(65) Prior Publication Data

US 2008/0036678 A1 Feb. 14, 2008

(30) Foreign Application Priority Data

Aug. 8, 2006 (KR) ..... 10-2006-0074501

(51) Int. Cl.
*H01Q 11/12* (2006.01)

(52) U.S. Cl. ..... 343/741; 343/742; 343/866

(58) Field of Classification Search ..... 343/741, 343/742, 866
See application file for complete search history.

(56) References Cited

U.S. PATENT DOCUMENTS 3,641,576 A * 2/1972 Farbanish ..... 343/743
3,956,751 A * 5/1976 Herman ..... 343/744
4,342,999 A * 8/1982 Woodward et al. ..... 343/702
4,518,965 A * 5/1985 Hidaka ..... 343/742
4,647,937 A 3/1987 Hidaka et al.
2004/0178958 A1 9/2004 Kadambi et al.
2005/0024290 A1 2/2005 Aisenbrey
2005/0092836 A1 * 5/2005 Kudo ..... 235/436
2006/0143899 A1 7/2006 Tuttle et al.

FOREIGN PATENT DOCUMENTS

JP 2002117383 A 4/2002
JP 2004021484 A 1/2004
KR 1020060040312 A 10/2006
KR 100688253 B1 2/2007

* cited by examiner

*Primary Examiner*—Tho G Phan
(74) *Attorney, Agent, or Firm*—Sughrue Mion, PLLC

(57) ABSTRACT

A loop antenna is provided having a matching circuit integrally formed includes a radiator which is formed in a loop shape; and a matching circuit including an extension part extended from one side of the radiator to an inner side of the loop and a bend part bent from an end of the extension part several times. Accordingly, the space for the installation of the loop antenna can be reduced and the design modification of the matching circuit can be facilitated.

15 Claims, 7 Drawing Sheets

LOOP ANTENNA HAVING MATCHING CIRCUIT INTEGRALLY FORMED

CROSS-REFERENCE TO RELATED APPLICATIONS

This application claims priority from Korean Patent Application No. 10-2006-0074501 filed on August 8, 2006, in the Korean Intellectual Property Office, the disclosure of which is incorporated herein by reference in its entirety.

BACKGROUND OF THE INVENTION

1. Field of the Invention

Apparatuses consistent with the present invention relate to a loop antenna having a matching circuit integrally formed. More particularly, the present invention relates to a loop antenna having a matching circuit integrally formed thereon to facilitate design and modification of the matching circuit and reduce the antenna size.

2. Description of the Related Art

Mostly, loop antennas are formed in a loop shape such as quadrangle and circle, and utilized in various fields according to the antenna length.

The loop antenna features low input resistance. The design of the loop antenna should take account of its length to match to input resistance 50Ω of the general antenna.

As for the square loop antenna, the input resistance approximates 50Ω and the input reactance approximates zero when the loop length is close to one wavelength in the impedance curve. That is, only when the length of the loop antenna is designed to one wavelength, resonance is generated to the loop antenna.

Also, a radiation pattern of the loop antenna differs depending on the length of the loop antenna. For instance, when the length of the loop antenna is shorter than one wavelength, the radiation is produced along the plane of the loop antenna. When the length of the loop antenna is longer than one wavelength, the radiation is generated perpendicular to the plane of the loop antenna. Thus, in order to regulate the radiation pattern of the loop antenna, the length of the loop antenna is adjusted.

Yet, in adjusting the radiation pattern by making the length of the loop antenna shorter or longer than one wavelength, it is hard to match the input resistance and the input reactance because of the properties of the loop antenna. Accordingly, when the length of the loop antenna is shorter or longer than one wavelength, a separate matching circuit is required for the matching of the input resistance and the input reactance.

However, space is required for the installation of the separate matching circuit. Additionally, after mounting the matching circuit on the device, it is not easy to change the design of the matching circuit because of the interaction with other circuit elements.

Therefore, it is desirable to reduce the size of the device having the loop antenna and facilitate the design of the matching circuit by minimizing the space occupied by the matching circuit at the design phase of the loop antenna.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above. An aspect of the present invention is to provide a loop antenna having a matching circuit integrally formed thereon, which reduces an installation space and facilitates the design of the matching circuit.

According to an aspect of the present invention, a loop antenna having a matching circuit integrally formed includes a radiator which is formed in a loop shape; and a matching circuit which includes an extension part extended from one side of the radiator to an inner side of the loop and a bend part bent from an end of the extension part several times.

One side of the radiator may be open, one open end may be a feed point, the other open end may be a short point, and the extension part may include of a pair of extension lines which extend from an area opposite to the open side.

The bend part may include of a pair of meander lines which are bent in a zigzag fashion several times from ends of the extension lines in a cross direction, and ends of the meander lines may be connected to each other.

The extension part may serve as a capacitor and the bend part may serve as an inductor to configure an LC circuit.

The matching circuit may control an input reactance.

A resonant frequency may lower as a length of the extension part extends. A resonant frequency may lower as a length of the bend part, which is formed in a cross direction of the extension part, extends.

The loop antenna may further include a resistance control part which is formed along the inner side of the radiator in parallel at an interval from the radiator.

The resistance control part may include of a pair of control lines which extend from the feed point and the short point, respectively, up to an area adjacent to the extension part.

The resistance control part may control an input resistance by functioning as a stub of a dipole type.

A total length of the extension part and the bend part may be about 1λ.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF THE EXEMPLARY EMBODIMENTS OF THE PRESENT INVENTION

Figure 1:
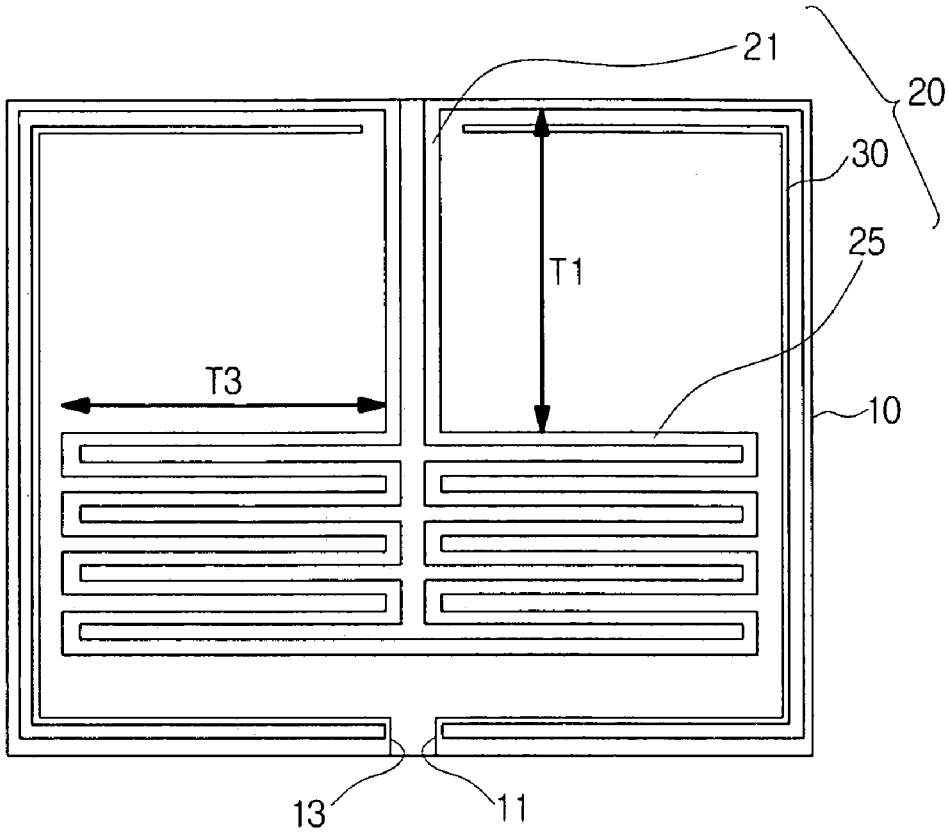
FIG. 1 is a plane view of a loop antenna according to an exemplary embodiment of the present invention.

Exemplary embodiments of the present invention will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

FIG. 1 is a plane view of a loop antenna according to an exemplary embodiment of the present invention.

The loop antenna includes a radiator 10 for radiating electromagnetic waves and a matching circuit 20 for adjusting an input reactance of the loop antenna. The radiator 10 and the matching circuit 20 are mounted on a circuit board and spaced apart at an interval.

The radiator 10 is formed in a loop shape such as square and circle. In FIG. 1, the radiator 10 of the square loop is depicted. The radiator 10 is formed with a conductive wire or a strip line having one wavelength in length. One side of the radiator 10 is open and its both open ends are bent toward the circuit board. The both ends are connected to a resonator (not shown). One end becomes a feed point 11 and the other end becomes a short point 13. The feed point 11 receives current from the resonator and the short point 13 provides the residual current to the resonator. The radiator 10 is about 1λ in length.

The matching circuit 20 is configured within the loop of the radiator 10.

The matching circuit 20 includes an extension part 21 connected to the radiator 10, a bend part 25 connected to the extension part 21 and bent several times, and a resistance control part 30 formed along the inner side of the radiator 10.

The extension part 21 includes of a pair of extension lines which extend inward from one side of the radiator 10. One of the extension lines is connected to the feed point 11 and the other is connected to the short point 13. The extension lines extend toward the inside of the radiator 10 to a certain length T1 in parallel, and serve as a capacitor.

The bend part 25 includes of a pair of meander lines which are connected to the ends of the extension lines and bent zigzag several times in the cross direction of the extension lines, respectively. Ends of the meander line are connected to each other. The bend part 25 serves as an inductor.

Figure 2:
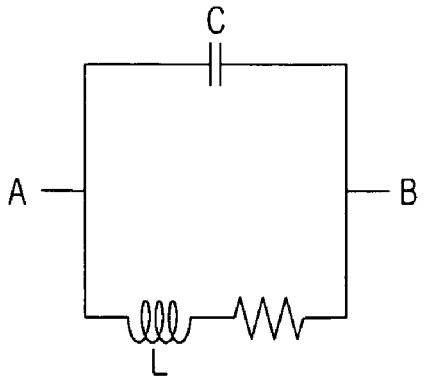
FIG. 2 is an equivalent-circuit diagram of the matching circuit of FIG. 1.

As such, since the extension part 21 serves as the capacitor and the bend part 25 serves as the inductor, the matching circuit 20 configures an LC resonant circuit as shown in FIG. 2.

Figure 3:
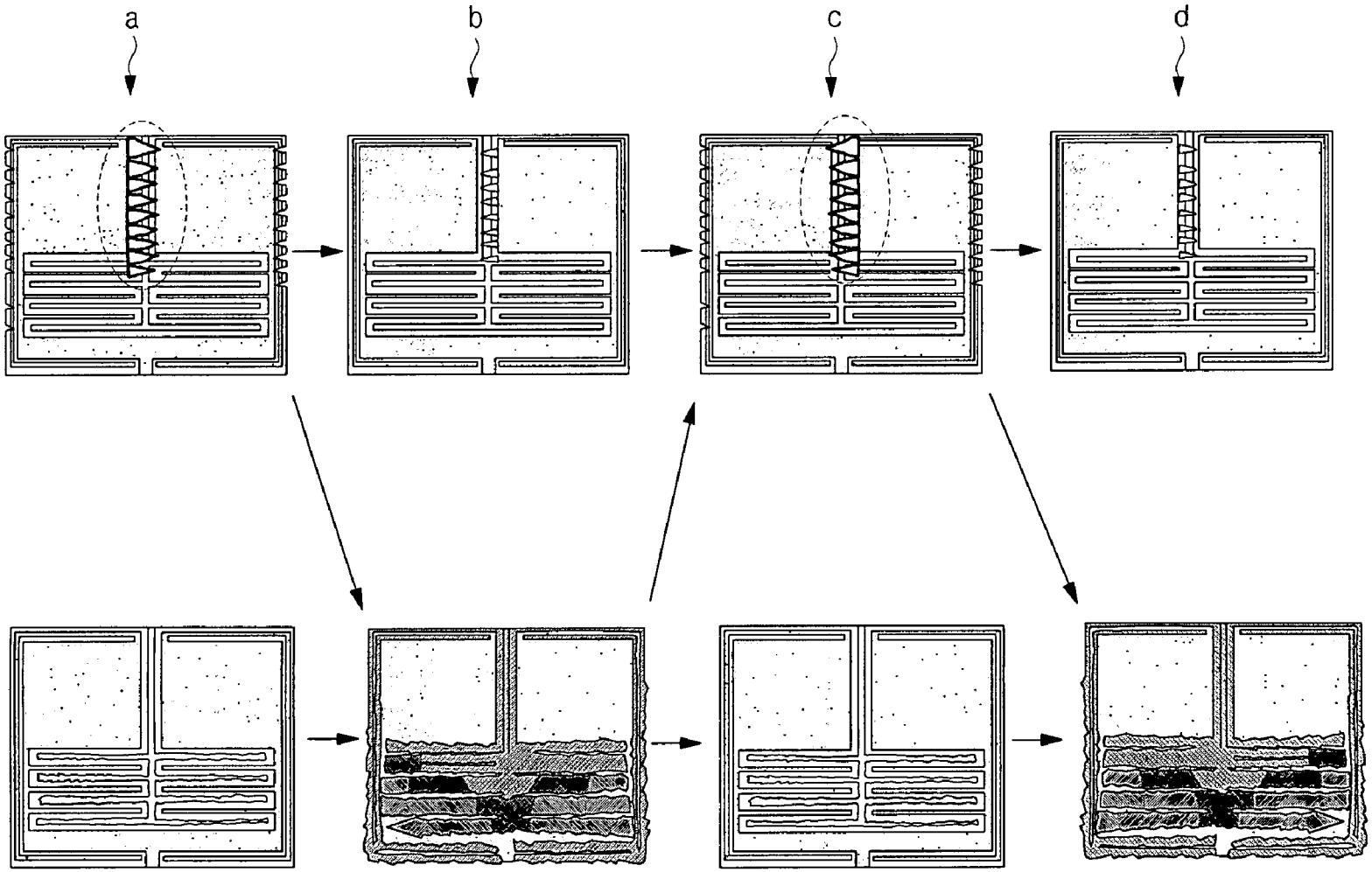
FIG. 3 depicts circuits showing changes of electric field and current according to phase variation of the matching circuit of FIG. 1.

FIG. 3 depicts matching circuits a-d showing changes of electric field and current according to phase variation of the matching circuit of FIG. 1. in each of the matching circuits a-d, the upper diagrams depict the electromagnetic field distribution in the loop antenna, and the lower diagrams depict the current distribution in the loop antenna.

Specifically, matching circuit a depicts the electromagnetic field and the current distribution within the loop antenna at a phase of 45 degrees. The electromagnetic field distribution shows the electromagnetic field is generated only over the extension part 21 functioning as the capacitor. Matching circuit b exhibits the magnetic field is generated over the bend part 25 functioning as the inductor at a phase of 135 degrees. Next, the electromagnetic field is generated over the extension part 21 at a phase of 225 degrees as shown in matching circuit c. At a phase of 315 degrees, the magnetic field is generated over the bend part 25 as shown in matching circuit d.

As the extension part 21 functions as the capacitor and the bend part 25 functions as the inductor, the electromagnetic field and the magnetic field are produced to the extension part 21 and the bend part 25 in an alternating manner according to the phase variation. This is the same principle as the resonance produced to the LC resonant circuit. As one can see from matching circuits a-d, the matching circuit 20 functions as the LC resonant circuit.

Meanwhile, the total length of the extension part 21 and the bend part 25 is about 1λ, and produce the standing wave. It is possible to control the input reactance and the resonant frequency of the loop antenna using the matching circuit 20.

Figure 4:
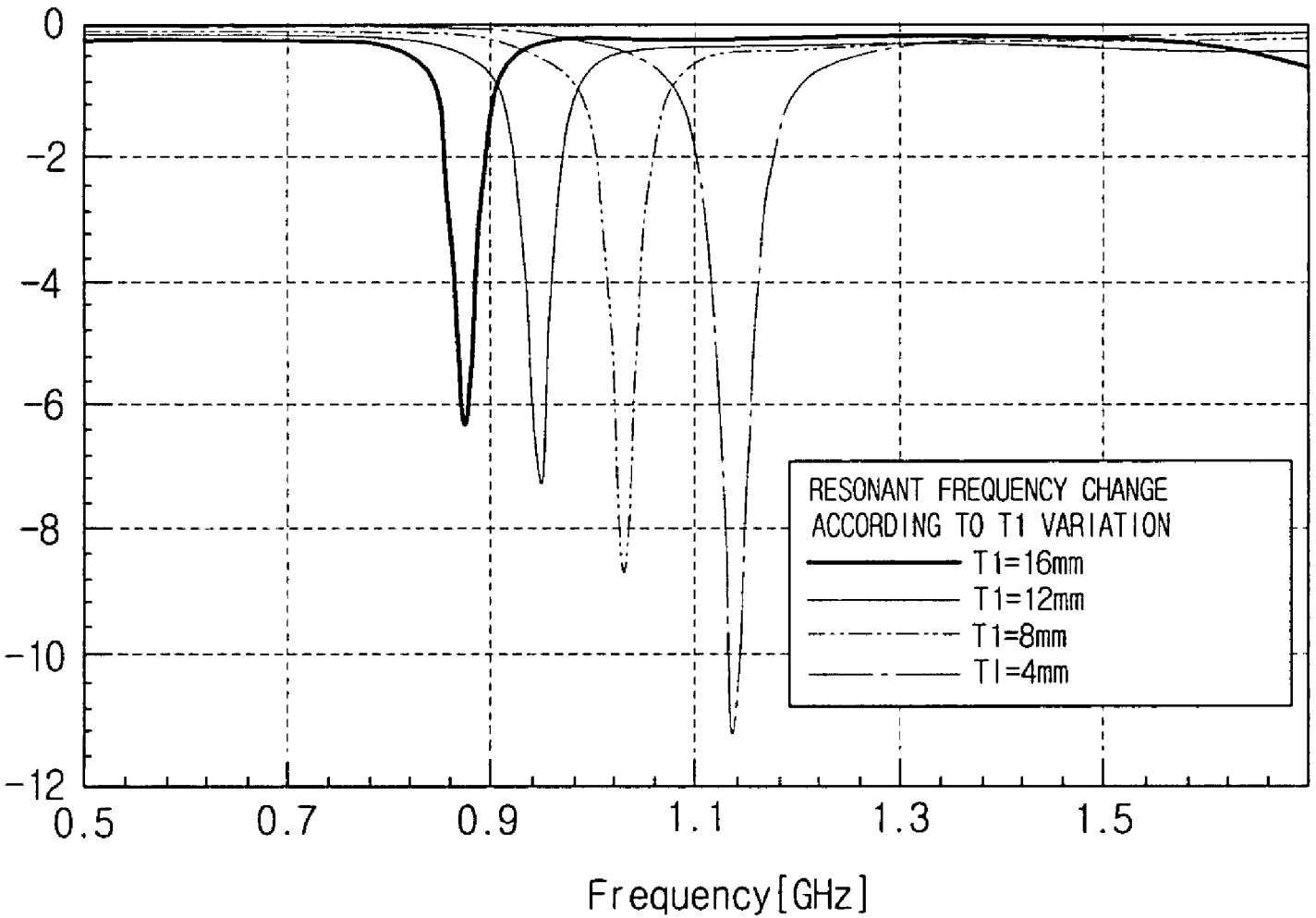
FIG. 4 is a graph showing changes of resonant frequency according to an adjustment of length T1 of the extension part in the loop antenna of FIG. 1.

FIG. 4 is a graph showing changes of the resonant frequency according to the adjustment of length T1 of the extension part 21 in the loop antenna of FIG. 1.

FIG. 4 shows the resonant frequency when the length T1 of the extension part 21 is 4 mm, 8 mm, 12 mm, and 16 mm. When the length T1 of the extension 21 is 4 mm, the resonant frequency is generated at about 1.15 GHz. The resonant frequency is generated at about 1.0 GHz for 8 mm, about 0.95 GHz for 12 mm, and about 0.87 GHz for 16 mm.

That is, the greater length T1 of the extension part 21, the greater capacitive property. As the total length of the matching circuit 20 increases, the resonant frequency band lowers. Hence, the resonant frequency can be shifted by adjusting the length T1 of the extension part 21.

Figure 5:
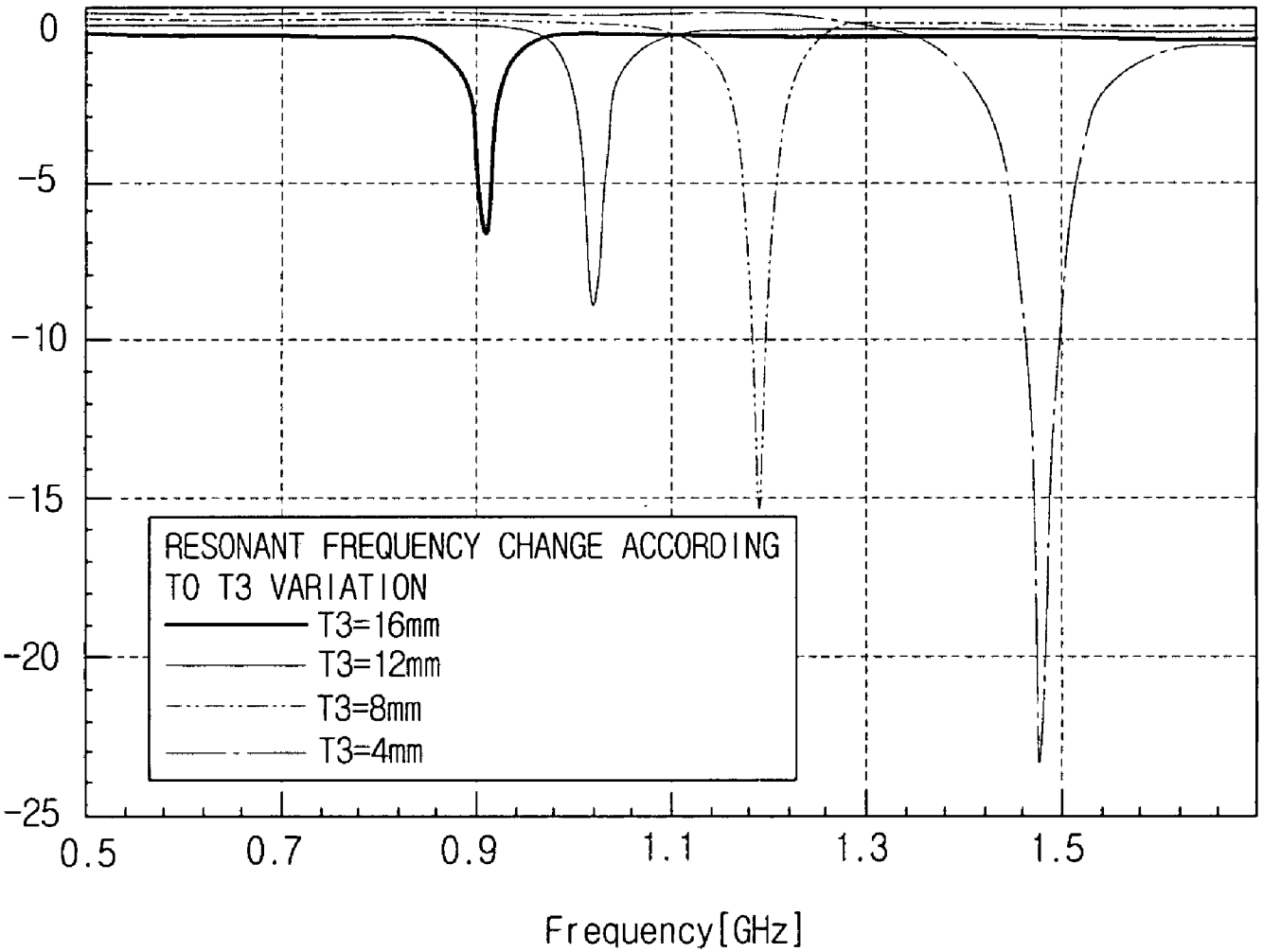
FIG. 5 is a graph showing changes of resonant frequency according to an adjustment of width T3 of the bend part in the loop antenna of FIG. 1.

FIG. 5 is a graph showing changes of resonant frequency according to the adjustment of width T3 of the bend part 25 in the loop antenna of FIG. 1.

FIG. 5 shows the resonant frequency when the width T3 of the bend part 25 is 4 mm, 8 mm, 12 mm and 16 mm. The resonant frequency is generated at about 1.5 GHz for 4 mm, about 1.2 GHz for 8 mm, about 1.0 GHz for 12 mm, and about 0.9 GHz for 16 mm.

That is, the greater width T3 of the bend part 25, the greater inductive property. As the length of the meander lines is extended, the resonant frequency lowers. Hence, the resonant frequency can be shifted by adjusting the width T3 of the bend part 25.

The resistance control part 30 is bent inward from the feed point 11 and the short point 13 in parallel with the radiator 10 and extended along the inner side of the radiator 10 in parallel with the radiator 10 at an interval. The end of the resistance control part 30 is extended up to an adjacent area of the extension part 21. Accordingly, the resistance control part 30 is formed in a "⊏"shape along the radiator 10 to thus configure a pair of control lines facing each other.

Since the resistance control part 30 is configured as the pair of the control lines facing each other, it functions as a stub of a dipole type. Thus, the resistance control part 30 can control the input resistance of the loop antenna and enables the impedance matching when the resonant frequency is changed according to the adjustment of the lengths of the extension part 21 and the bend part 25 by compensating the characteristic of the loop antenna with the low input resistance.

Figure 6:
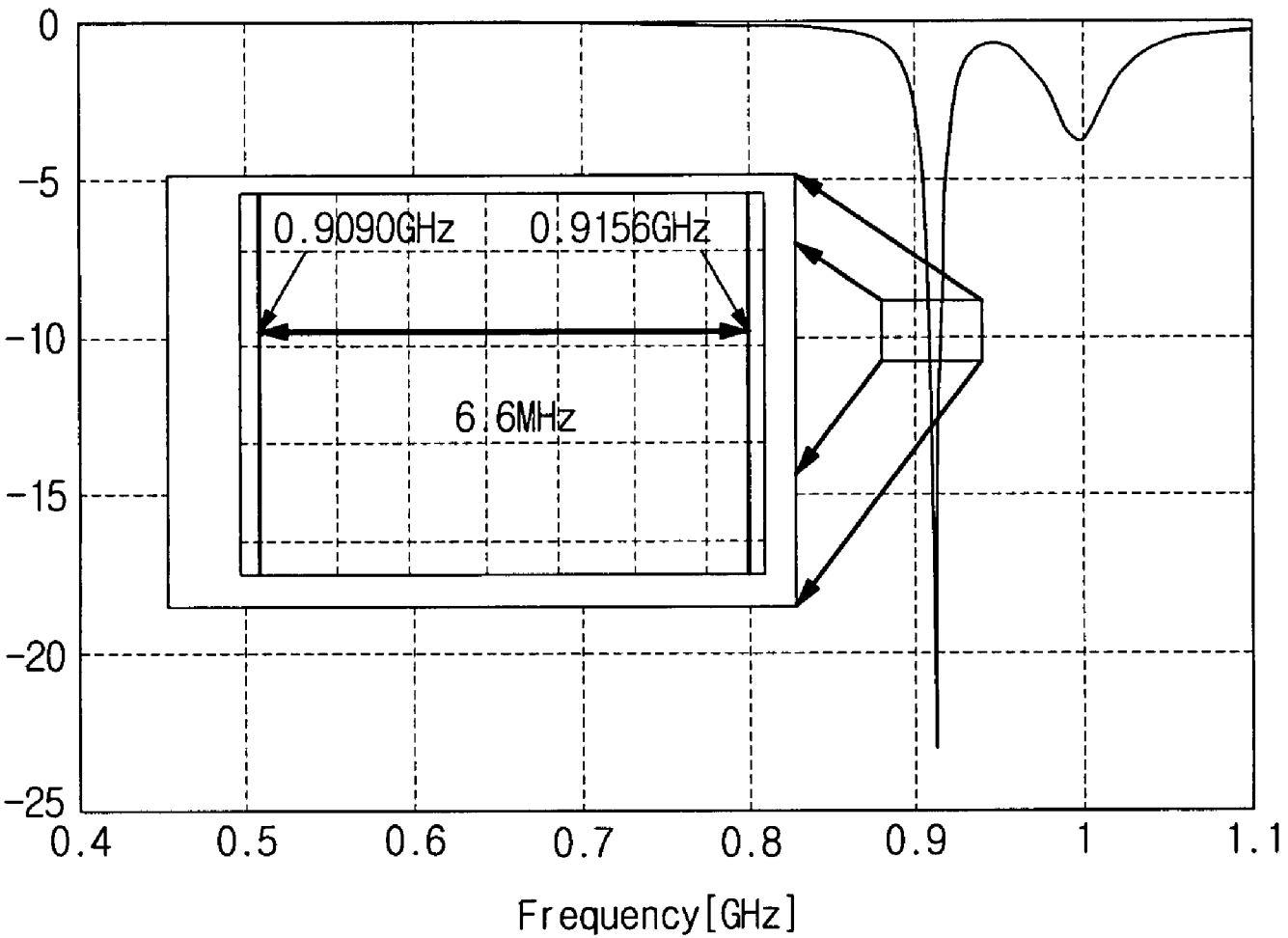
FIG. 6 is a graph showing an S11 characteristic of the loop antenna according to an exemplary embodiment of the present invention.

FIG. 6 is a graph showing an S11 characteristic of the loop antenna according to an exemplary embodiment of the present invention.

FIG. 6 shows the S11 characteristic of the loop antenna designed by setting the lengths of the radiator 10, the extension part 21, the bend part 25, and the resistance control part 30 to certain values according to an exemplary embodiment of the present invention. As shown in FIG. 6, the loop antenna produces the resonant frequency at about 0.91 GHz. At this time, the bandwidth at −10 dB is 6.6 MHz or so between 0.9090 GHz and 0.9156 GHz. The gain of the loop antenna is measured to −0.8732 dB. In conclusion, the loop antenna of the exemplary embodiment of the present invention is available in the corresponding band and particularly, suitable for an antenna of the Radio Frequency Identification (RFID) system.

Figure 7B:
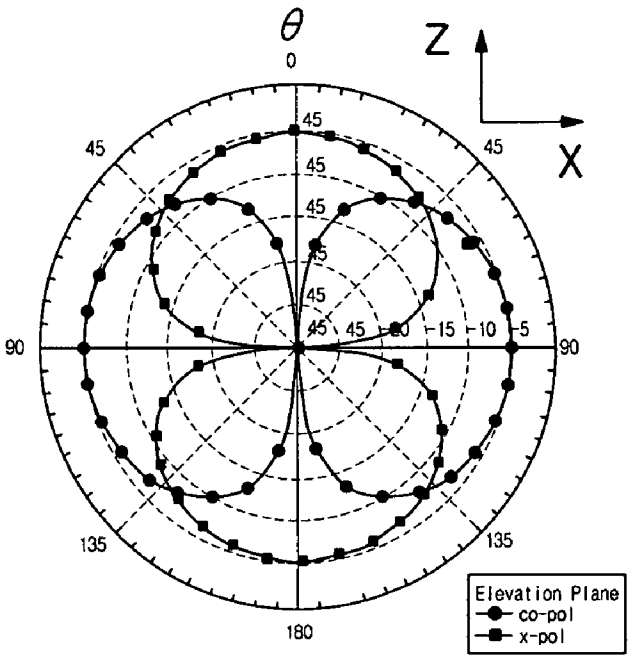
FIGS. 7A through 7C are graphs showing radiation characteristics of the loop antenna of FIG. 1.
Figure 7A:
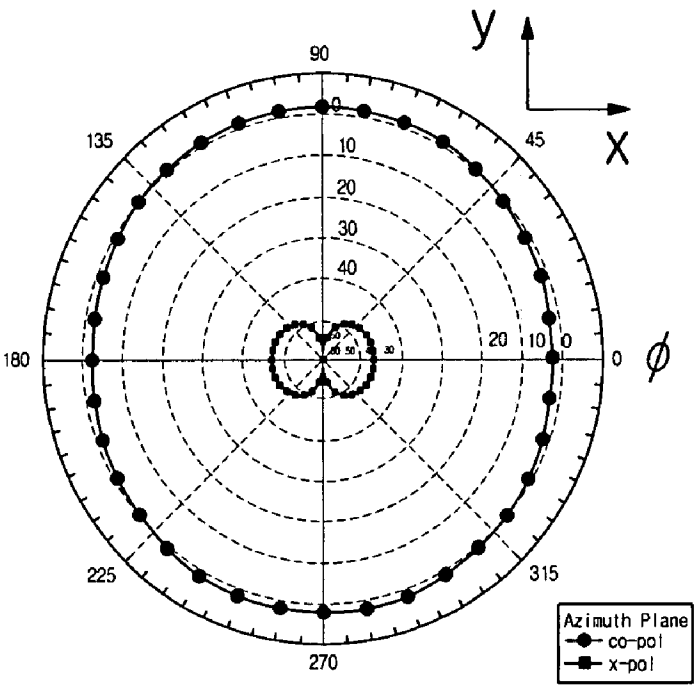
Figure 7C:
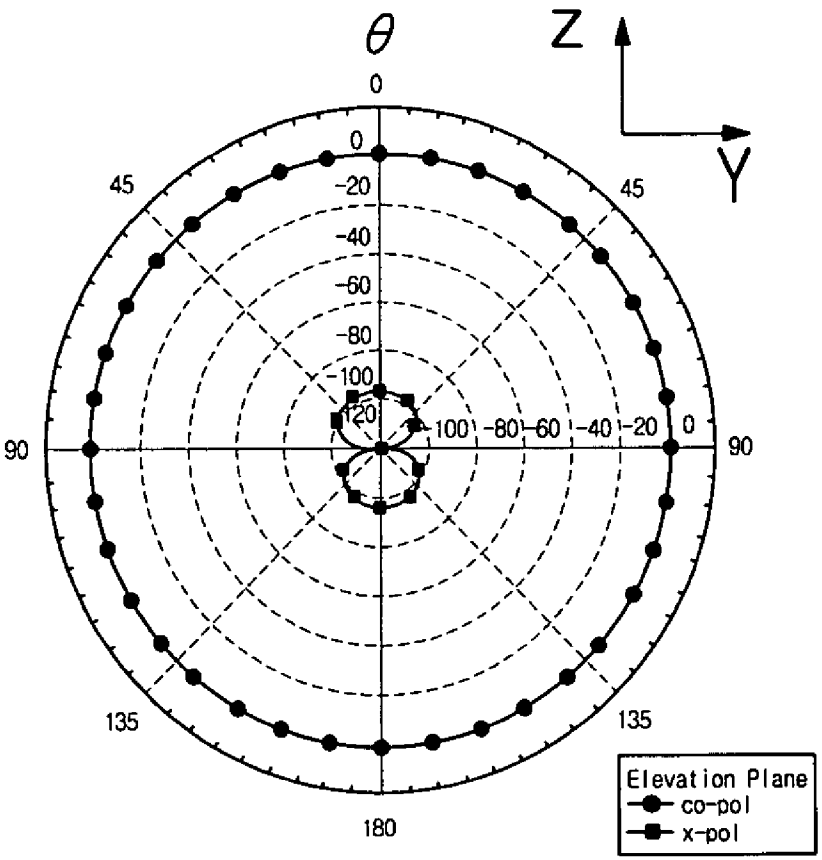

FIGS. 7A through 7C are graphs showing radiation characteristic of the loop antenna of FIG. 1.

In the plane of the loop antenna, when defining the width T3 direction of the bend part 25 as the x axis, the length T1 direction of the extension part 21 as the y axis, and the perpendicular direction to the plane of the loop antenna as the z axis, FIG. 7A shows the radiation pattern in view of the x-y axis, FIG. 7B shows the radiation pattern in view of the z-x axis, and FIG. 7C shows the radiation pattern in view of the z-y axis.

In FIGS. 7A through 7C, the loop antenna exhibits omnidirectionality with respect to the planes. This implies the matching circuit 20 mounted on the loop antenna does not affect the radiation pattern of the loop antenna.

As such, the loop antenna is integrally formed with the matching circuit 20. Thus, the matching circuit 20 does not require additional space and thus reduces the size of the device to which the antenna is installed. Also, the resonant frequency can be changed by controlling the capacitor component and the inductor component through the simple adjustment of the length of the extension part 21 and the width of the resistance control part 30. Therefore, the design modification of the matching circuit 20 is facilitated.

In light of the forgoing, the exemplary embodiments of the present invention reduce the space for the installation of the loop antenna and facilitates the design modification of the matching circuit.

The foregoing exemplary embodiments are merely exemplary and should not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A loop antenna comprising:

a radiator which is formed in a loop; and a matching circuit, integrally formed with the loop antenna, which comprises an extension part which extends from one side of the radiator to an inner side of the loop and a bend part bent from an end of the extension part, wherein the matching circuit is disposed inside the radiator, wherein one side of the radiator is open, a first open end is a feed point, a second open end is a short point, and the extension part comprises a pair of extension lines which extend from an area opposite to the open one side.

2. The loop antenna as claimed in claim 1, wherein the bend part comprises a pair of meander lines which are bent in a zigzag shape from ends of the extension lines in a cross direction, and ends of the meander lines are connected to each other.

3. The loop antenna as claimed in claim 2, wherein the pair of meander lines includes a first meander line and a second meander line, and the first meander line and the second meander line have a mirror symmetry with respect to each other about an axis which dissects the open one side, wherein the first meander line and the second meander line have vertical portions which are parallel to the axis and horizontal portions which are perpendicular to the axis, and wherein the horizontal portions are longer than the vertical portions.

4. The loop antenna as claimed in claim 1, wherein the matching circuit controls an input reactance.

5. The loop antenna as claimed in claim 1, wherein a resonant frequency lowers as a length of the extension part extends.

6. The loop antenna as claimed in claim 1, wherein a resonant frequency lowers as a length of the bend part, which is formed in a cross direction of the extension part, extends.

7. The loop antenna as claimed in claim 1, wherein a total length of the extension part and the bend part is substantially equal to 1λ.

8. The loop antenna as claimed in claim 1, wherein the matching circuit is disposed inside the radiator loop.

9. The loop antenna as claimed in claim 1, wherein a length of the extension part is fixed to correspond to a predetermined resonant frequency of the loop antenna.

10. A loop antenna comprising:

a radiator which is formed in a loop; and a matching circuit, integrally formed with the loop antenna, which comprises an extension part which extends from one side of the radiator to an inner side of the loop and a bend part bent from an end of the extension part, wherein the matching circuit is disposed inside the radiator, wherein the extension part serves as a capacitor and the bend part serves as an inductor to configure an LC circuit.

11. A loop antenna comprising:

a radiator which is formed in a loop;

a matching circuit, integrally formed with the loop antenna, which comprises an extension part which extends from one side of the radiator to an inner side of the loop and a bend part bent from an end of the extension part; and a resistance control part which is formed along an inner side of the radiator in parallel at an interval from the radiator, wherein the matching circuit is disposed inside the radiator.

12. The loop antenna as claimed in claim 11, wherein one side of the radiator is open, a first open end is a feed point, and a second open end is a short point.

13. The loop antenna as claimed in claim 12, wherein the resistance control part comprises a pair of control lines which extends from the feed point and the short point, respectively, up to an area adjacent to the extension part.

14. The loop antenna as claimed in claim 11, wherein the resistance control part controls an input resistance by functioning as a stub of a dipole type.

15. A loop antenna comprising:

a radiator which is formed in a loop; and a matching circuit, integrally formed with the loop antenna, which comprises an extension part which extends from one side of the radiator to an inner side of the loop and a bend part bent from an end of the extension part, wherein the matching circuit is disposed inside the radiator, wherein the bend part comprises a plurality of bends.

* * * * *